US007446327B2

(12) United States Patent
Stresau

(10) Patent No.: US 7,446,327 B2
(45) Date of Patent: Nov. 4, 2008

(54) APPARATUS FOR AMPLIFYING A STREAM OF CHARGED PARTICLES

(75) Inventor: Richard W. Stresau, Sydney (AU)

(73) Assignee: ETP Electron Multipliers Pty Ltd., New South Wales (AU)

( * ) Notice: Subject to any disclaimer, the term of this patent is extended or adjusted under 35 U.S.C. 154(b) by 344 days.

(21) Appl. No.: 11/408,620

(22) Filed: Apr. 21, 2006

(65) Prior Publication Data

US 2006/0255283 A1 Nov. 16, 2006

(30) Foreign Application Priority Data

Apr. 21, 2005 (AU) ..... 2005902005

(51) Int. Cl.
*H01J 43/00* (2006.01)

(52) U.S. Cl. ..... 250/492.3; 250/396 R; 250/397; 250/283; 250/489; 250/281; 313/103 R; 313/104; 313/532; 313/528; 315/39.63

(58) Field of Classification Search ..... 250/396 R, 250/397, 398, 399, 400, 489, 281, 283, 282, 250/492.1, 492.3; 313/103, 104, 532, 528; 315/39.63

See application file for complete search history.

(56) References Cited

U.S. PATENT DOCUMENTS 4,398,090 A * 8/1983 Eloy et al. ..... 250/299
4,710,675 A * 12/1987 Stephenson ..... 313/532
4,825,066 A * 4/1989 Nakamura et al. ..... 250/207
4,835,383 A * 5/1989 Mahoney et al. ..... 250/281
4,912,315 A * 3/1990 Arakawa et al. ..... 250/207
5,481,108 A * 1/1996 Yano et al. ..... 250/283
5,598,061 A * 1/1997 Nakamura et al. ..... 313/532
5,616,987 A * 4/1997 Ohmura et al. ..... 313/533
5,637,959 A * 6/1997 Kyushima et al. ..... 313/533
2002/0195556 A1* 12/2002 Yoshinari et al. ..... 250/283
2004/0108451 A1* 6/2004 Hansen ..... 250/281
2005/0253512 A1* 11/2005 McAlpine ..... 313/533
2006/0097159 A1* 5/2006 Herschbein et al. ..... 250/309

FOREIGN PATENT DOCUMENTS

FR 2822291 A1 * 9/2002

* cited by examiner

*Primary Examiner*—Jack I. Berman
*Assistant Examiner*—Michael J Logie
(74) *Attorney, Agent, or Firm*—Fulwider Patton LLP

(57) ABSTRACT

Apparatus for amplifying a stream of primary charged particles comprises a body defining a chamber and an entrance aperture for receiving the stream of primary charged particles into the chamber, and an incident dynode, adapted to be charged to a pre-determined electrical potential, having a surface positioned in the chamber to be impacted by said primary charged particles at an angle of incidence greater than 30° from the surface normal and in response to the impact to generate a stream of secondary charged particles.

31 Claims, 2 Drawing Sheets

APPARATUS FOR AMPLIFYING A STREAM OF CHARGED PARTICLES

RELATED APPLICATIONS

This application claims priority from Australian patent application 2005902005 filed Apr 21, 2005.

FIELD OF THE INVENTION

This invention relates generally to the detection of charged particles and is concerned in particular with amplifying a stream of charged particles for enhanced detection by electron multipliers or other particle detectors.

In the context of this specification, a "charged particle" may be an ion or other charged particle, that is capable, when having predetermined characteristics, to cause an impacted surface to generate an electron or an ion. A common application of electron multipliers, however, is the detection of specific ions, for example in mass spectrometers, and hence for convenience particles to be detected will sometimes be referred to herein as ions.

BACKGROUND ART

An electron multiplier typically includes an ion impact plate as the first element of the device. This ion impact plate is an integral component of most ion detectors and has the function of converting the input ions, to be detected, into electrons or secondary ions. The emission of low-energy secondary electrons or secondary ions from the impact plate, is the desired response to the plate being struck by the input ions, and forms the principal signal to be amplified by the detector. These secondary electrons or secondary ions are referred to as signal particles.

A specialised form of ion impact plate, referred to as a high energy dynode (HED), has come into common use in commercial mass spectrometers during the past decade. An HED, is an ion impact plate that is maintained at a high electrical potential (typically between 5 kV and 15 kV). Electrons or ions, generated by ions impacting the HED, are focussed onto the 1st dynode (or input area) of any electron multiplying device.

The HED provides two major functions, which have led to its wide use in commercial mass spectrometers:

A. Because of the high potential maintained on the HED, ions acquire considerable energy when approaching its surface. Secondary electron yield and secondary ion yield (defined as the average number of electrons or ions emitted as a result of an ion impact) increases with increased ion impact energy. As a result ions striking an HED generate more signal particles than would otherwise be possible, and, therefore, the HED increases the ion detection sensitivity of the associated electron multiplier and of the instrument using the electron multiplier. This is particularly useful for high mass ions because of the inherent property of most materials to give lower secondary electron yields and secondary ion yields for higher mass ions.

B. When detecting positive ions a negative high voltage is applied to the HED which attracts the incoming ions and repels the secondary electrons generated as a result of the ion impact. Appropriately shaping the HED and/or surrounding electrodes will ensure that most of the electrons are focussed into the associated electron multiplier. When detecting negative ions a positive high voltage is applied to the HED, which attracts the incoming ions and focuses positive secondary ions generated as a result of the ion impact. The same electron/ion optics used to direct the secondary electrons will be effective for the positive secondary ions. The process of conversion from negative to positive ions by the HED is widely used as the critical step in negative ion detection and is an important function provided by the HED. Other methods are employed for negative ion detection but are not as widely used.

One drawback of the HED is its propensity to generate noise or spurious signals (spontaneous output current which is unrelated to input ions), particularly in the presence of a large partial pressure of helium as is common in gas chromatography mass spectrometry (GCMS). A major mechanism causing this noise is the ionization of meta-stable particles or neutral particles in the region of the HED. One of the primary objects of this invention, at least in one or more aspects or embodiments, is to minimise or eliminate this noise.

A further object of this invention, at least in one or more aspects or embodiments, is to increase the sensitivity of an HED and thus increase its usefulness when used in both positive ion detection mode and negative ion detection mode.

SUMMARY OF THE INVENTION

The present invention embodies three different aspects to achieve one or more of the afore-stated objects. Each of these aspects or any combination of them could be used without the others to achieve some or all of the objects and it is intended that this invention extends to any combination of one or more of these aspects.

In a first aspect, the invention provides apparatus for amplifying a stream of primary charged particles, comprising:

a body defining a chamber and an entrance aperture for receiving said stream of primary charged particles into the chamber; and an incident dynode, adapted to be charged to a pre-determined electrical potential, having a surface positioned in said chamber to be impacted by said primary charged particles at an angle of incidence greater than 30° from the surface normal and in response to said impact to generate a stream of secondary charged particles.

According to the first aspect of the invention, the geometry of the dynode, which is typically an HED, is arranged so that the incoming ions or particles to be detected are incident onto the HED surface at a large angle with respect to the surface normal. Because secondary electron yield and secondary ion yield increases with the angle of incidence, larger incident angles will result in larger signal from the HED and enhanced instrument sensitivity. As a practical matter the incident angle should be greater than 30° from the surface normal to be effective, while 60° or greater would be a reasonable and preferred design objective.

In its second aspect, the invention provides apparatus for amplifying a stream of primary charged particles, comprising:

a body defining a chamber and an entrance aperture for receiving said stream of primary charged particles into the chamber on an entry trajectory; and an incident dynode, adapted to be charged to a pre-determined electrical potential, having a surface positioned in said chamber to be impacted by said primary charged particles and in response to said impact to generate a stream of secondary charged particles;

wherein said dynode surface is offset from said entry trajectory and an electrode configuration is provided to generate an electrostatic field for deflecting said primary charged particles to said dynode surface while neutral particles remain on said trajectory, whereby at least most of such neutral particles and any ions generated thereby within said chamber do not impact said dynode surface.

In a preferred implementation of the second aspect of the invention, in order to minimize or eliminate spurious signals, neutrals and/or neutral meta-stable ions are never allowed to pass through the sensitive region of the incident dynode, typically an HED. The "sensitive region" of the HED is defined as any volume in which ions or charged particles generated in or passing through the region will be attracted to the HED and result in a secondary particle that is included in said stream of secondary charged particles to be directed in use to an associated electron multiplier's input. The electrostatic fields along the path of the neutral particles are preferably arranged so that any ions generated along the path are attracted or deflected to a portion of the device that will not lead to the generation of output signal.

In a third aspect, the invention provided apparatus for amplifying a stream of primary charged particles, comprising:

a body defining a chamber and an entrance aperture for receiving said stream of primary charged particles into the chamber; and an incident dynode, adapted to be charged to a pre-determined electrical potential, having a surface positioned in said chamber to be impacted by said primary charged particles and in response to said impact to generate a stream of secondary charged particles;

wherein said surface of the incident dynode has respective surface portions having different secondary particle generation characteristics, and wherein an electrode configuration is provided to generate an electrostatic field for selectively deflecting said primary charged particles to selectively impact said surface portions.

The conversion mechanisms employed by a typical HED are considerably different for a positive ion detection mode and the negative ion detection mode. As a result the surface material needed to achieve the highest secondary yield or optimal sensitivity may be different in each case. Using different dynode surface materials for the two different modes of operation will increase the device's sensitivity but is not practical with current HED designs. Arranging the apparatus so that different surface regions of the HED are coated with different materials can make this a practical concept. Changing the voltage on an appropriately shaped and positioned electrode configuration can be used to selectively steer the incoming ion beam from one surface region of the HED to the other at the appropriate times.

Preferably, the dynode surface is an internal surface of a cone or of an axially extending section of a cone, or an angular segment thereof. The internal dynode surface may have, at its outer periphery, a focussing flange for the secondary charged particles which is an internal surface of an axially extending section of a second cone.

Preferably, the electrostatic field means deflects the primary charged particles through an angle greater than 90°. In specific embodiments, this angle may be greater than 180°.

BRIEF DESCRIPTION OF THE DRAWINGS

The invention will now be further described, by way of example only, with reference to the accompanying drawings, in which.

DESCRIPTION OF PREFERRED EMBODIMENTS

Figure 1:
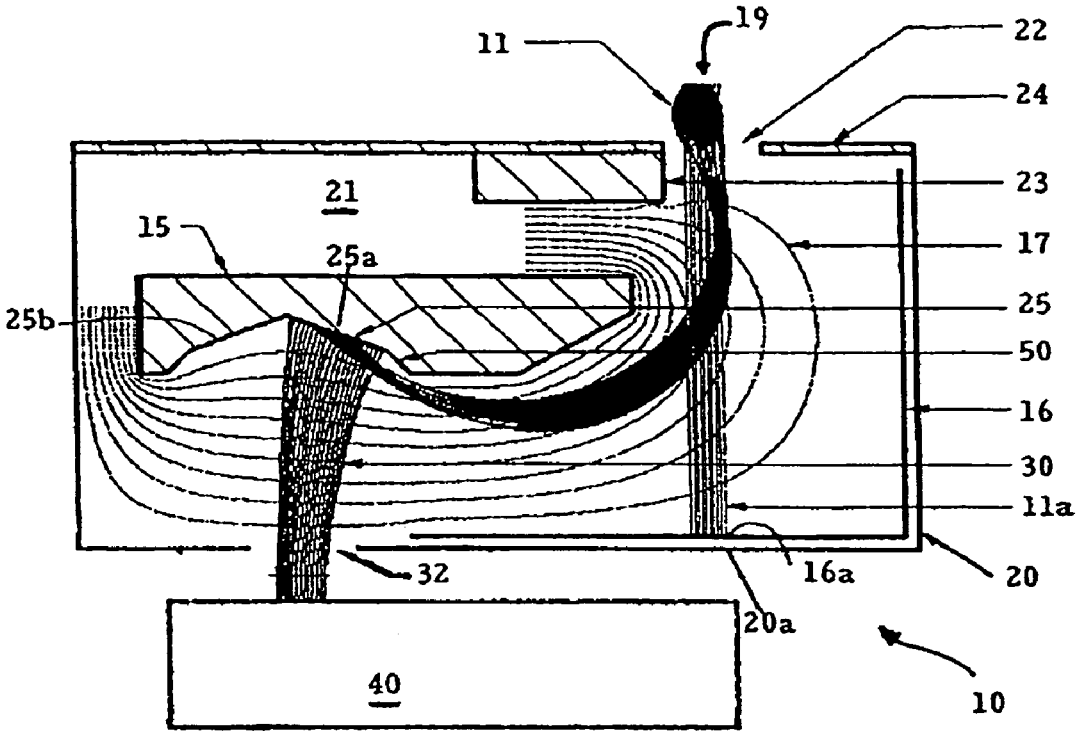
FIG. 1 is a cross-sectional diagram of a first embodiment of apparatus in accordance with all three aspects of the invention for amplifying a stream of charged particles.

The apparatus 10 illustrated in FIG. 1 consists of a high energy incident dynode (HED) 15 and a rectangular deflector electrode 16 positioned within a chamber 21 deferred by a metallic box-like housing 20. Ions 11, which may, for example, be ions from a quadrupole mass analyser, enter the device on a trajectory 19 through an ion entrance aperture 22 in a plate 24 of housing 20, and are directed to a shaped conversion surface 25 of dynode 15 by an appropriately shaped electrostatic field generated by electrode 16 when activated. The field is indicated by electrostatic equipotentials 17. Dynode surface 25 is therefore offset from trajectory 19. Dynode 15 is adapted to be charged to a pre-determined electrical potential, e.g. in the range 5 to 15 KeV. Ions 11 impact conversion surface 25: In response, surface 25 generates a stream of secondary charged particles 30 such as electrons or ions. The HED conversion surface 25 is shaped so that all or most of the secondary particles 30 generated at the surface are focused through a secondary particle exit aperture 32 in housing 20, and thence in typical applications onto the sensitive area of an associated electron multiplier or other particle detector, indicated at 40.

An ion entrance deflector 23 is provided adjacent aperture 22 to initially focus the beam of incoming ions 11. The electrostatic field 17 generated by electrode 16 then deflects the ions 11 through greater than 90°, indeed about 130°-145°, to impact conversion surface 25.

In this implementation of the invention, the HED conversion surface 25 is an internal surface of a cone of an included angle such that the incoming ions 11 will all be incident on this surface at nearly the same angle of incidence, which is greater than 60° [from the surface normal]. In general, this angle should be greater than 30°. As a result the secondary particle yield from ions impacting on this surface will be significantly larger than from conventional HEDs where near normal incidence is the most usual practice. Experimental work has shown that ions impacting a surface at ~60° from normal will generate approximately twice the number of secondary particles as would be expected from normal incidence.

A focussing flange 50 provided about the outer periphery of conversion surface 25 is a section of a cone and is used to help focus the secondary particles 30 onto the sensitive portion of the electron multiplier or particle detector 40, but will not be necessary for all implementations of the invention. Flange 50 is co-axial with conical conversion surface 25 and has a smaller included angle. For example, the respective included angles of conical conversion surface 25 and conical section flange 50 are respectively about 120° to 160° and about 80° to 120°. Analysis has shown the illustrated geometry to be very effective for focusing purposes.

Adjusting the voltage on the deflector electrode 16 is an effective method of moving the incoming ion target position from one area to another on the HED conversion surface 25. This enables a simple method of selecting different surface portions of the HED to be utilised for different situations. In accordance with a preferred implementation of the third aspect of the invention, different portions of the HED conversion surface 25, e.g. portions 25*a* and 25*b*, are coated with different materials to provide different secondary particle generation characteristics. The voltage applied to the deflector electrode 16 can then be used to steer the incoming ion beam 19 to either the portion 25*a* with a high secondary electron yield material for positive ions (the condition illustrated) or to the portion 25*b* with a high secondary ion yield material for negative ions.

Negative high voltage is applied to the HED for positive ion detection and positive high voltage is applied for negative ion detection. Because the sign of the particles and the sign of the HED voltage are both changed when switching from positive to negative ion mode, the ion and secondary electron or secondary ion trajectories will follow the same paths for both modes. If it were desired to use the same portion of HED conversion surface in both modes of operation the sign of the deflection voltage would also need changing during mode change. If the sign of the deflection voltage remained unchanged during mode change the target position of the incoming ions would move during the change. It would be possible to organise the design to utilise this as a method of selectively moving the ion target area to the desired surface portion 25*a* or 25*b* during the mode change. Other circumstances may result in this being an inconvenient method in which case the appropriate voltage would need to be adjusted for each mode of operation.

Neutral particles and neutral meta-stable ions 11*a* will pass through the ion entrance aperture 22 and continue undeflected on trajectory 19 through the chamber 21 to the opposite wall 16*a* of electrode 16 and 20*a* of housing 20. A hole may be positioned in the opposite wall at this point 16*a* and 20*a* so that the neutral particles pass through and impact a surface outside of the HED housing 20. This may not be necessary with this device because the electrostatic field shape will prevent secondary particles generated by the neutral particle impact on the opposite wall 16*a* from reaching the sensitive portion 25*a* and 25*b* of the HED. A detailed analysis has indicated that ions or electrons originating along the trajectory path of the neutrals 11*a* within chamber 21 of HED housing 20, or originating in the region of neutral impact with housing wall 16*a* as shown in FIG. 1, will not be able to reach the sensitive portion 25*a* and 25*b* of the HED 15.

Figure 2:
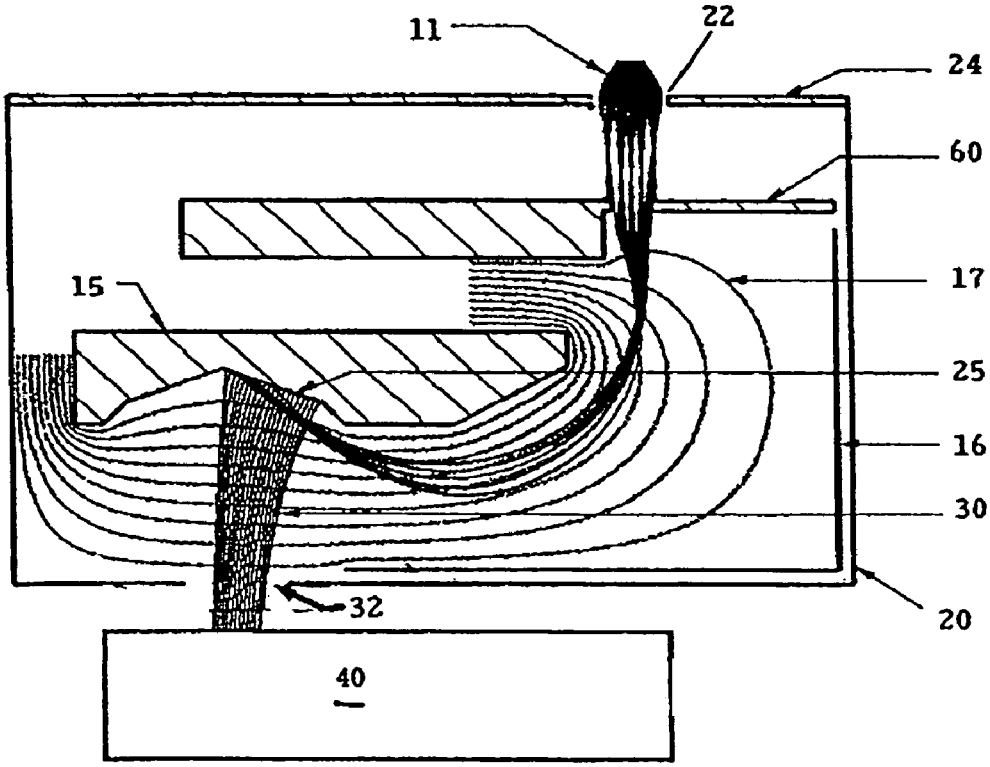
FIGS. 2 and 3 are similar views of respective modified embodiments.

FIG. 2 illustrates a generally similar implementation of the invention that is modified to include an accelerating electrode 60 as commonly used in a number of commercial mass spectrometers for accelerating incoming ions 11 before they impact incident dynode surface 25. Electrode 60 is placed just inside entrance aperture 22.

Figure 3:
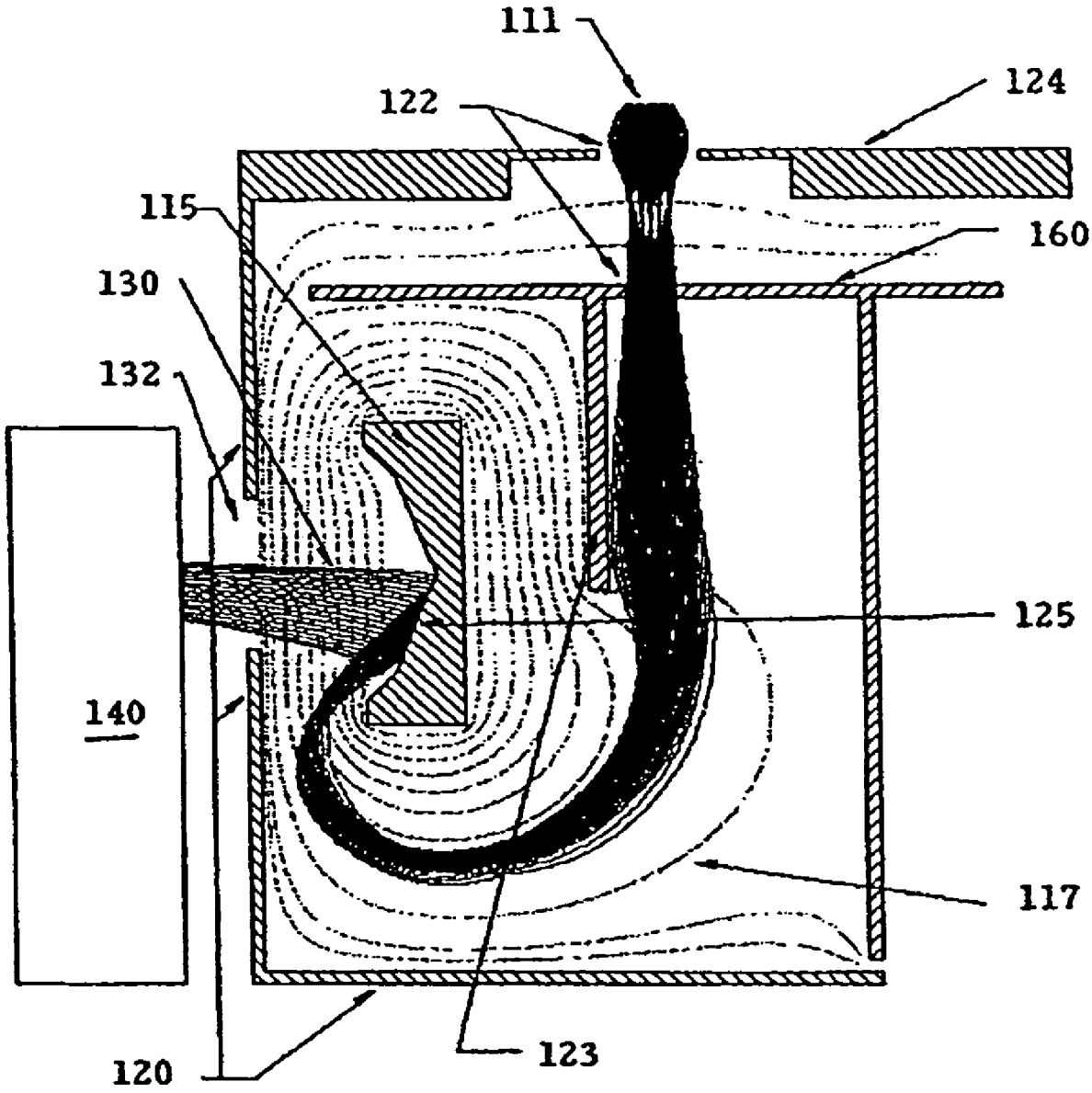

FIG. 3, in which like parts are indicated by like reference numerals preceded by a "1", illustrates another embodiment that also includes an accelerating electrode 160. In this case, the ions entering the input aperture 122 are deflected through an angle greater than 180°, e.g. about 200° to 250°, to impact the HED conversion surface 125. Ions generated along the undeflected path of neutral particles that enter the input aperture, are attracted to portions of the device that will not generate an output signal. This implementation could also be configured without the accelerating electrode and achieve the objectives of the invention.

The invention claimed is:

1. Apparatus for amplifying a stream of primary charged particles, comprising: a body defining a chamber and an entrance aperture for receiving said stream of primary charged particles into the chamber; and an incident dynode offset from an entry trajectory of the primary charged particles, adapted to be charged to a pre-determined electrical potential, having a surface positioned in said chamber to be impacted by said primary charged particles at an angle of incidence greater than 30° from the surface normal and in response to said impact to generate a stream of secondary charged particles.

2. Apparatus according to claim 1 wherein said dynode surface is an internal surface of a cone or of a section of a cone, or an angular segment thereof.

3. Apparatus according to claim 2 wherein said internal surface includes a conical apex.

4. Apparatus according to claim 2, wherein said internal surface has, at its outer periphery, a focussing flange for said secondary charged particles which is an internal surface of an axially extending section of a second cone.

5. Apparatus according to claim 1 wherein an electrode configuration is provided to generate an electrostatic field for deflecting said primary charged particles to said dynode surface.

6. Apparatus according to claim 5 wherein said electrostatic field deflects said primary charged particles through an angle greater than 90°.

7. Apparatus according to claim 6 wherein said dynode surface is an internal surface of a cone or of a section of a cone, or an angular segment thereof.

8. Apparatus according to claim 7, wherein said internal surface has, at its outer periphery, a focussing flange for said secondary charged particles which is an internal surface of an axially extending section of a second cone.

9. Apparatus according to claim 5 wherein said electrostatic field deflects said primary charged particles through an angle greater than 180°.

10. Apparatus according to claim 9 wherein said dynode surface is an internal surface of a cone or of a section of a cone, or an angular segment thereof.

11. Apparatus according to claim 10, wherein said internal surface has, at its outer periphery, a focussing flange for said secondary charged particles which is an internal surface of an axially extending section of a second cone.

12. Apparatus according to claim 5 wherein said entry trajectory and said offset of said dynode surface is such that neutral particles remain on said trajectory, whereby at least most of such neutral particles and any ions generated thereby within said chamber do not impact said dynode surface.

13. Apparatus according to claim 1 wherein said surface of the incident dynode has respective surface portions having different secondary particle generation characteristics, and wherein an electrode configuration is provided to generate an electrostatic field for selectively deflecting said primary charged particles to selectively impact said surface portions.

14. Apparatus according to claim 13 wherein said surface portions having different secondary particle generation characteristics are provided by respective different coatings.

15. Apparatus according to claim 13 wherein said dynode surface is an internal surface of a cone or of a section of a cone, or an angular segment thereof.

16. Apparatus according to claim 15, wherein said internal surface has, at its outer periphery, a focussing flange for said secondary charged particles which is an internal surface of an axially extending section of a second cone.

17. Apparatus according to claim 13 wherein said dynode surface is offset from an entry trajectory and an electrode configuration is provided to generate an electrostatic field for deflecting said primary charged particles to said dynode surface.

18. Apparatus according to claim 1 wherein said incident dynode is a high energy dynode (HED).

19. Apparatus according to claim 1 further including an electrode for accelerating said primary charged particles before they impact said incident dynode.

20. Apparatus for amplifying a stream of primary charged particles, comprising:

a body defining a chamber and an entrance aperture for receiving said stream of primary charged particles into the chamber on an entry trajectory; and an incident dynode, adapted to be charged to a pre-determined electrical potential, having a surface positioned in said chamber to be impacted by said primary charged particles and in response to said impact to generate a stream of secondary charged particles;

wherein said dynode surface is offset from said entry trajectory and an electrode configuration is provided to generate an electrostatic field for deflecting said primary charged particles to said dynode surface while neutral particles remain on said trajectory, whereby at least most of such neutral particles and any ions generated thereby within said chamber do not impact said dynode surface.

21. Apparatus according to claim 20 wherein said electrostatic field deflects said primary charged particles through an angle greater than 90°.

22. Apparatus according to claim 21 wherein said dynode surface is an internal surface of a cone or of a section of a cone, or an angular segment thereof.

23. Apparatus according to claim 21 wherein said electrostatic field deflects said primary charged particles through an angle greater than 180°.

24. Apparatus according to claim 20 wherein said surface of the incident dynode has respective surface portions having different secondary particle generation characteristics, and wherein an electrode configuration is provided to generate an electrostatic field for selectively deflecting said primary charged particles to selectively impact said surface portions.

25. Apparatus according to claim 24 wherein said surface portions having different secondary particle generation characteristics are provided by respective different coatings.

26. Apparatus according to claim 20 wherein said incident dynode is a high energy dynode (HED).

27. Apparatus according to claim 20 further including an electrode for accelerating said primary charged particles before they impact said incident dynode.

28. Apparatus for amplifying a stream of primary charged particles, comprising:

a body defining a chamber and an entrance aperture for receiving said stream of primary charged particles into the chamber; and an incident dynode, adapted to be charged to a pre-determined electrical potential, having a surface positioned in said chamber to be impacted by said primary charged particles in response to said impact to generate a stream of secondary charged particles;

wherein said surface of the incident dynode has respective surface portions having different secondary particle generation characteristics, and wherein an electrode configuration is provided to generate an electrostatic field for selectively deflecting said primary charged particles to selectively impact said surface portions.

29. Apparatus according to claim 28 wherein said surface portions having different secondary particle generation characteristics are provided by respective different coatings.

30. Apparatus according to claim 28 wherein said incident dynode is a high energy dynode (HED).

31. Apparatus according to claim 28 further including an electrode for accelerating said primary charged particles before they impact said incident dynode.

* * * * *